US005312650A

United States Patent [19]

Dalal et al.

[11] Patent Number: 5,312,650

[45] Date of Patent: May 17, 1994

[54] METHOD OF FORMING A COMPOSITE ARTICLE BY METAL SPRAYING

[75] Inventors: Ranes P. Dalal; John M. McFadden; Mark J. Straszheim; Louis E. Dardi, all of Muskegon, Mich.

[73] Assignee: Howmet Corporation, Greenwich, Conn.

[21] Appl. No.: 143,030

[22] Filed: Jan. 12, 1988

[51] Int. Cl.[5] ..... B05D 1/10

[52] U.S. Cl. ..... 427/295; 427/314; 427/318; 427/319; 427/376.7; 419/48; 419/49

[58] Field of Search ..... 427/295, 328, 383.9, 427/436

[56] References Cited

U.S. PATENT DOCUMENTS

| | | | |
|---|---|---|---|
| 3,839,618 | 10/1974 | Muehlberger | 219/76 |
| 4,063,939 | 12/1977 | Weaver et al. | 75/208 R |
| 4,152,223 | 5/1979 | Wallace et al. | 427/383.9 |
| 4,246,323 | 1/1987 | Bornstein et al. | 427/383.9 |
| 4,418,124 | 11/1983 | Jackson et al. | 428/548 |
| 4,447,466 | 5/1984 | Jackson et al. | 427/34 |
| 4,492,737 | 1/1985 | Conolly | 428/552 |
| 4,526,839 | 7/1985 | Herman et al. | 427/423 |
| 4,529,452 | 7/1985 | Walker | 148/11.5 Q |
| 4,537,742 | 8/1985 | Siemers et al. | 419/8 |
| 4,574,451 | 3/1986 | Smashey et al. | 29/423 |
| 4,577,431 | 3/1986 | Siemers et al. | 42/76 A |
| 4,581,300 | 4/1986 | Hoppin, III et al. | 428/546 |
| 4,657,823 | 4/1987 | Siemers et al. | 428/61 D |

FOREIGN PATENT DOCUMENTS 1583738 of 0000 United Kingdom .

OTHER PUBLICATIONS

Hoppin, G. S. and Danesi, W. P. "Manufacturing Process for Long-Life Gas Turbines", Journal of Metals, Jul. 1986, pp. 20-23.

Peterson, L. G. "HIP Diffusion Bonding of PM Alloys for Composite Land-Based Gas Turbine Buckets", Metal Powder Reports, Oct. 1986, pp. 729-738.

Jackson, M. R. and Siemers, P. A. "Plasma Deposited Ni-Al-Mo Metal-Matrix Composites", Proc. of Materials Research Society, vol. 98, 1987, pp. 347-352.

*Primary Examiner*—Donald P. Walsh
*Assistant Examiner*—J. N. Greaves
*Attorney, Agent, or Firm*—Finnegan, Henderson, Farabow, Garrett & Dunner

[57] ABSTRACT

The method of making a composite article of different metal portions by spraying molten metal on the surface of a solid metal member that has been cleaned and preheated in a controlled atmosphere at low pressure. The molten metal is sprayed on the surface of the solid metal member, preferably by plasma jet spraying. It is rapidly solidified to be adherent to the surface of the solid metal member to form a composite preform. The composite preform is cooled at a rate sufficiently low to reduce residual stresses and then hot pressed to eliminate voids in the sprayed metal portion and metallurgically bonded to the surface of the solid member.

29 Claims, 2 Drawing Sheets

METHOD OF FORMING A COMPOSITE ARTICLE BY METAL SPRAYING

FIELD OF THE INVENTION

The present invention relates to the field of composite materials and, more particularly, to a process for forming a composite article comprised of metal.

BACKGROUND OF THE INVENTION

Process innovation increasingly contributes to improvements in the temperature capability and component reliability of gas turbine engine components. Innovations in investment casting have produced: complex, thin-walled, air-cooled gas turbine engine blades; integrally cast rotors and nozzles; high temperature, creep-resistant, directionally solidified (DS) columnar grained and single crystal airfoils; hot isostatic pressing (HIP) of castings to densify casting shrinkage porosity; and proprietary techniques to form very fine grain castings. Advanced powder metal manufacturing and consolidation processing, coupled with advanced extrusion and forging processes, have provided the capability to produce fine grain disks which exhibit improved low-cycle fatigue strength.

Low pressure plasma spray technology has introduced a new method to produce fine grain components and coatings. Few process methods, however, have been developed which successfully combine the high temperature creep properties of large-grained structures with the tensile and low-cycle fatigue capabilities of fine-grained structures in a single component. It is the objective of this invention to provide such a unique processing capability. The following discussion describes processes utilized in the prior art.

Integrally cast rotors having an equiaxed microstructure have been successfully used in many small gas turbine applications. The need for increased thrust and horsepower in military and commercial aircraft has led to more demanding requirements. Consequently, designers have used the traditional separately bladed approach, i.e., fabricating a fine-grained, forged disk; machining slots in the disk to accept machined blade roots; and inserting cast blades of the desired grain structure into the slots, thereby achieving a mechanical attachment. Machining slots and blade roots are costly processing steps. This method also limits the number of blades that can be attached, especially in smaller engines. A design with a large number of blades is desirable for higher performance.

Turbine disks are fabricated by wrought processes which utilize either ingot or powder metal starting stock. The powder metal disks are generally consolidated by hot isostatic processing (HIP) and demonstrate reduced alloy segregation compared to ingot metallurgy. Powder metal disks are, however, susceptible to thermally induced porosity (TIP) from residual argon used in powder atomization. Any oxygen contamination of powders can form an oxide network resulting in metallographically detectable prior particle boundaries which are known sites of fracture initiation. These limitations make powder metal disks costly in terms of both processing and quality controls.

Those skilled in the art of turbine engine design have recognized the potential advantages of combining the ease of fabrication and the structural integrity of monolithic integrally cast rotors with the high performance capability obtainable in separately bladed turbine engine rotors. Several approaches have been developed to produce such a turbine rotor.

One approach involves casting an equiaxed, hollow blade ring and then diffusion bonding a separately produced powder metal disk to the inside diameter of the ring. Interference fit and brazing are usually required to achieve complete bonding during HIP'ing. This approach has the disadvantage of requiring four separate processes: 1) casting; 2) precision machining; 3) powder metal HIP consolidation; and 4) a second HIP operation to achieve final bonding. Each of these processes are expensive and may create additional costs arising from defect scrap losses.

Another method uses powder metal in an investment mold which has directionally solidified or single crystal cast blades within it. The mold is loaded in a metal can, covered with an inert pressure-transmitting media, vacuum sealed, and HIP'ed. This combined blade/powder metal approach has less process steps than the interference fit approach but is severely limited in dimensional control due to blade/mold movement during consolidation of the 65–70% dense powder.

In view of the above-described disadvantages of the known methods for fabricating turbine components, a method for forming such components which overcomes many of these limitations is disclosed.

Accordingly, it is an object of the invention to provide a method of making turbine rotors which combines the property advantages of fine-grained disks and conventional investment castings.

It is a further objective of the invention to provide a method of making a composite article comprised of different metal portions. The different metal portions can be of different compositions or may be of the same composition with different microstructures.

Additional objects and advantages will be set forth in part of the description which follows, and in part, will be obvious from the description, or may be learned by practice of the invention.

SUMMARY OF THE INVENTION

To achieve the foregoing objects in accordance with the purpose of invention as embodied and broadly described herein, the invention is a method of making a composite metal article by spraying molten metal on the surface of at least one solid metal member. The method includes the steps of providing a solid metal member and facilitating the formation of a metallurgical bond at the interface between the surface of the metal member and metal sprayed thereon by cleaning the surface of the metal member and preheating it in a controlled atmosphere at low pressure. The molten metal is sprayed onto the surface of the metal member and rapidly solidified incrementally to form a solid, partially porous sprayed metal portion. The metal portion is adherent to at least a portion of the surface of the metal member to form a composite preform. Residual stresses are reduced at the interface by cooling the preform at a sufficiently low cooling rate. The preform is then hot pressed to substantially eliminate voids in the sprayed metal portion and metallurgically bond the sprayed portion to the surface of the metal member.

Preferably, the means for eliminating voids in the preform comprises hot isostatic pressing. In this preferred embodiment, the solid metal member is gas impervious and contains a cavity therein. The formation of a metallurgical bond at the interface between the surface of the cavity and the metal sprayed therein is facilitated by cleaning the surface of the cavity and preheating the metal member in a controlled atmosphere at low pressure. Molten metal is sprayed into the cavity and rapidly solidified incrementally within the cavity to form a solid partially porous sprayed metal portion. The metal portion which substantially fills the cavity and adheres to at least a portion of the surface of the cavity forms a composite preform with the outermost portion of the solidified metal portion being substantially gas impervious. Residual stresses at the interface are reduced by cooling the preform at a sufficiently low cooling rate. The preform is then hot isostatically pressed to substantially eliminate voids in the sprayed metal portion and metallurgically bond the sprayed metal portion to the surface of the cavity.

Preferably the above processes are utilized with nickel-base metal alloys and in such a process the preferred preheat temperature of the metal member receiving the sprayed molten metal is in the range of from about 1500° F. to 1800° F. It is further preferred that the solid metal member surface be cleaned after pre-heating with a thermal plasma by a negative polarity DC arc formed on the surface of the solid metal member.

DESCRIPTION OF THE PREFERRED EMBODIMENTS

The present invention will now be described in terms of preferred embodiments that are illustrative of the invention.

The invention is a method of making a composite metal article by spraying molten metal into at least one solid metal member. The method finds particular utility in making composite metal articles from metals for service at high temperature. The present invention can be used to form metal articles having different microstructures in different locations as, for example, a turbine component having a fine grained hub and single crystal blades. The examples set out herein are directed to nickel-base superalloys. The invention is, however, operable with other metals and alloys that are capable of being formed into a metal spray and solidified to form a structure that can be converted to a useful structure through appropriate thermomechanical treatments.

In accordance with the invention, the first step of the method is to provide a solid metal member. The purpose of the solid metal member is to both receive the molten metal being sprayed on its surface and to solidify the molten metal in the appropriate shape and microstructure.

Figure 1:
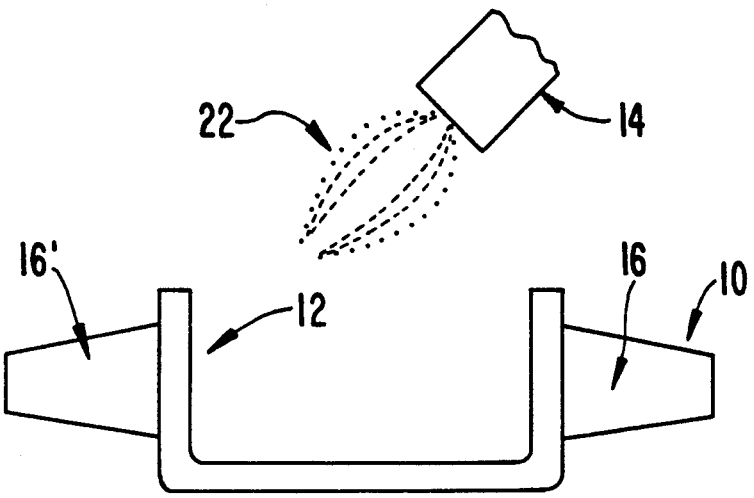
FIG. 1 is a schematic side view of a turbine component prior to the deposition of metal within a central cavity by means of the present invention.
Figure 2:
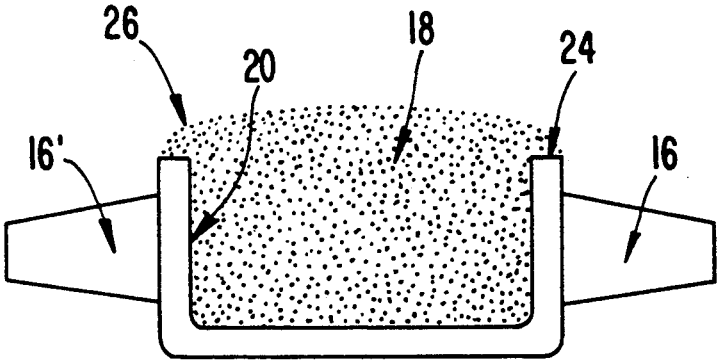
FIG. 2 is a schematic side view of the embodiment of FIG. 1 subsequent to the deposition of metal within the cavity.

As here embodied and depicted in FIGS. 1 and 2, the solid metal member is a portion of a turbine engine rotor 10 having a cavity 12 formed therein. The rotor 10 also includes blades 16 and 16' which may have a microstructure uniquely suited to the conditions imposed on the blades. The surface of the cavity receives the molten metal sprayed thereon from the nozzle schematically depicted as nozzle 14. The goal of the process is to form a metallurgical bond at the interface between the metal member and the material deposited thereon. For purposes of the present invention, a metallurgical bond is a continuous metallic structure at the interface of the members being joined. As here embodied and depicted in FIG. 2, there is a metallurgical bond formed between the spray deposited material 18 and the interior of the cavity 12 at the interface 20.

In the preferred embodiment, the material deposited in the cavity is consolidated by hot isostatic pressing. In such an embodiment a metallurgical bond between the surface of the cavity and the deposited metal is facilitated by the solid member and the outermost region of the material deposited being gas impervious. As a result, the gas pressure applied during hot isostatic pressing densifies the sprayed metal and eliminates both microscopic porosity and any macroscopic separation of the spray deposited material 18 at the interface 20 of the solid metal member, the rotor 10.

In accordance with the invention, the formation of a metallurgical bond at the interface between the surface of the metal member and the metal sprayed thereon is facilitated by cleaning the surface of the metal member and preheating it in a controlled atmosphere at low pressure. The formation of a metallurgical bond is difficult if the surface of the solid metal member receiving the sprayed metal has thereon impurities such as oxides, either as a continuous oxide layer or discontinuous oxide particles. Therefore, the method of the present invention should include the cleaning of the surface of the metal member. In a preferred embodiment, the process includes the step of cleaning the surface of the metal member in a plasma by forming a direct current arc on the surface of the metal member with the surface of the metal member being the cathode. Such a process is known as reverse arc cleaning and is described in an article by Shankar et al. in the October, 1981 issue of the Journal of Metals. Reverse arc cleaning removes surface impurities when such a step is conducted in a controlled atmosphere at low pressure.

In the embodiments disclosed herein, the vessel containing the article to be processed was initially evacuated below $10^{-3}$ Torr and the DC arc was generated in an atmosphere of argon and helium at a pressure in the range of from 30 to 50 torr during the cleaning process.

The cleaning can be accomplished by the reverse arc cleaning step previously described, both as a single step or multiple steps. In addition, the surface may be machined or chemically cleaned prior to the preheating step to eliminate any impurities that would impair the formation of a metallurgical bond at the interface.

In accordance with the invention, the solid metal member is preheated in a controlled atmosphere at low pressure. The preheating of the solid metal member affects the rate of heat transfer as the molten metal spray strikes the solid surface on which it is deposited. Because steep thermal gradients can result in residual stresses across the interface, the amount of preheating to minimize such gradients must be considered. For nickel-base alloys, preheating the solid metal member to a temperature in the range of from 1500° to 1800° F. is preferred. One of the advantages of the present invention is that the solid metal member can be preheated with an arc or by means of a plasma prior to the application of the sprayed molten metal, thereby providing an efficient production process capable of being automated.

In accordance with the invention, molten metal is sprayed onto the surface of the solid metal member. As here embodied and depicted schematically in FIG. 1, there is provided a nozzle 14 projecting sprayed molten metal 22 into the cavity 12. Preferably, the molten metal is sprayed by means of the introduction of powdered metal into a high velocity thermal plasma. Particular success has been experienced using a plasma spray apparatus manufactured by Electro Plasma Inc., of Irvine, Calif. Such an apparatus generates a high temperature plasma of flowing inert gas into which is injected solid metal powder which is melted by the high temperature plasma and projected, by movement of the plasma, toward the surface receiving the molten metal. To ensure a uniform deposition of the sprayed molten metal onto the surface of the solid metal member receiving it, the solid metal member may be moved or the plasma gun indexed in order to provide a configuration to the deposited material appropriate for the particular application.

As here embodied and depicted in FIGS. 1 and 2, the nozzle 14 is in a fixed position with respect to the cavity 12 and the article 10 is rotated with respect to the nozzle to deposit the solid metal within the cavity in the appropriate configuration. Where the cavity receiving the molten metal has an irregular configuration, it may be necessary to move both the solid metal member as well as the means for projecting the spray of molten metal in order to minimize the formation of voids at the interface between the cavity and the deposited material. The formation of voids at the interface is not desirable but is not entirely detrimental to the successful practice of the invention. Because the process is conducted with a controlled atmosphere, the surface of both the cavity and the metal deposited therein should be free of surface contamination. Thus, subsequent consolidation techniques such as hot isostatic pressing should close any minor voids at the interface and provide a metallurgical bond between the deposited material and the solid metal member at the interface. In such a manner, the deposited material is adherent to at least a portion of the surface of the metal member to form what is termed a composite preform. The composite preform is comprised of the metal deposited onto the solid metal member. The deposited metal may be porous or there may be voids at the interface between the solid metal member and the deposited metal.

The molten metal sprayed onto the surface of the metal member is rapidly solidified because of the temperature differential between the molten metal and the solid metal member even when the solid metal member is preheated. This affords the opportunity to control the microstructure of the deposited material. By controlling the deposition rate onto the solid metal member, the velocity of the molten metal spray, the droplet size of the molten metal spray and the temperature differential between the metal spray and the solid metal member, the deposited metal may have its crystalline structure determined by these variables. The molten metal solidifying incrementally to either the solid metal member or a previously deposited portion of the now solid material builds up as depicted schematically in FIG. 2 to form a partially porous sprayed metal portion 18.

The porous sprayed metal portion 18 is subsequently rendered fully dense for a dense fine-grained portion having a grain size in the range of from 15 microns to 45 microns. This range generally meets the grain size requirements of the hub of a turbine engine rotor.

In accordance with the invention, the method includes the step of reducing the residual stresses at the interface between the deposited material and the solid metal member by cooling the composite preform at a sufficiently low cooling rate. While the cooling rate is somewhat dependent on the preheat temperature of the solid metal member, its mass, composition and configuration for nickel-base materials, it has been found that a cooling rate in the range of from about 800° to 1500° F./hr is sufficient to bring the device to room temperature without causing detrimental residual stresses within the composite preform.

In accordance with the invention, the composite preform is hot pressed to substantially eliminate the voids in the sprayed metal portion and metallurgically bond the sprayed metal portion of the surface of the solid metal member. Preferably, this hot pressing is done under gas pressure thereby providing an isostatic pressure to the composite preform. In configurations that do not require the isostatic pressure, hot pressing of the composite preform by mechanical means can be sufficient to both densify the deposited material by eliminating voids therein. Subsequent to the consolidation of the article by hot isostatic pressing or hot pressing, the article can be heat treated to obtain the desired microstructure for both the newly deposited material and the solid metal member receiving the deposited material.

In the preferred embodiment where the deposited material is consolidated by hot isostatic pressing, the process should include the formation of a gas impervious layer on the surface of the partially porous sprayed metal portion 18. This provides the means of applying the gas pressure during hot isostatic pressing to densify the deposited material and eliminate any voids therein. In any embodiment depicted in FIGS. 1 and 2 where the article is consolidated by hot isostatic pressing, there should be a gas impervious bond between the edge of the deposited material 18 and the cavity 12 shown as the edge portion 24 so that gas pressure applied during hot isostatic pressing does not infiltrate to the interface 20 between the deposited material 18 and the cavity 12, thus preventing the elimination of the voids at that location. As shown in FIG. 2, the outermost portion 26 of the solidified metal portion 18 is also substantially gas impervious, thus facilitating consolidation by hot isostatic pressing of the spray deposited material 18.

The present invention has been successfully practiced with isostatic pressures of 15 to 25 KSI at temperatures of between 2125° to 2200° F. Those skilled in the art will recognize that superalloy materials having very fine grain sizes, such as those exhibited by the spray deposited material of this invention, will behave superplastically at temperatures of about 1800° to 2200° F. Thus, the step of hot isostatic pressing in connection with the invention could be carried out in that temperature range.

The present invention provides a method for combining materials of high creep strength with materials of high tensile and fatigue strength by means of a process that can be readily automated and controlled to provide composite articles unavailable through conventional techniques.

The present invention has been utilized in the following examples:

EXAMPLE 1

A dual-alloy composite gas turbine engine rotor was formed by the invention. In FIG. 1, the bladed ring member 10 was an investment cast Mar-M247 nickel-base superalloy, having a typical equiaxed grain size of ASTM M10-M15. The composition of the Mar-M247 is set out in Table I. The cavity of the member was cast with the blade ring so that the walls forming said cavity were continuous and gas impervious. The cavity was machined to remove surface discontinuities or oxides formed during the casting process and then cleaned by chemical treatments to remove any contamination from the machining process.

The cleaned blade ring was fixtured on a manipulator inside of a vacuum chamber and rotated at about 35 rpm during processing. The chamber was evacuated below $10^{-3}$ Torr to remove gaseous impurities from the chamber environment. A thermal plasma of high purity argon and helium from an EPI-03 plasma gun preheated the ring to about 1700°-1800° F. The plasma gun was oriented at an acute angle from normal with respect to the blade ring and was positioned at 15 inches from the cavity surface. Gun operating power was 68 KW. The chamber atmosphere was maintained at 30-50 torr during processing. A final, electrical arc cleaning of the cavity was accomplished by negatively biasing the bladed ring relative to the plasma gun. Immediately after this final cleaning, a molten nickel-base superalloy known as LC Astroloy was sprayed into the cavity by the plasma gun at a rate of about 100 g/min. The molten metal incrementally contacted the surfaces and rapidly solidified. The direction of the molten metal was controlled to substantially fill the cavity and provide a gas impervious seal between the bladed ring and the outer portion of the solidified metal hub, thus forming the dual-alloy composite preform shown in FIG. 2. The solidified metal hub was partially porous but the outermost portions were sufficiently dense to transmit gas pressure.

After controlled cooling of the dual alloy composite preform in the vacuum chamber, the preform was hot isostatically pressed (HIP) at 2165° F./25 KSI/4 h to consolidate voids and enhance metallurgical bonding of the bladed ring with the spray deposited hub.

Figure 3:
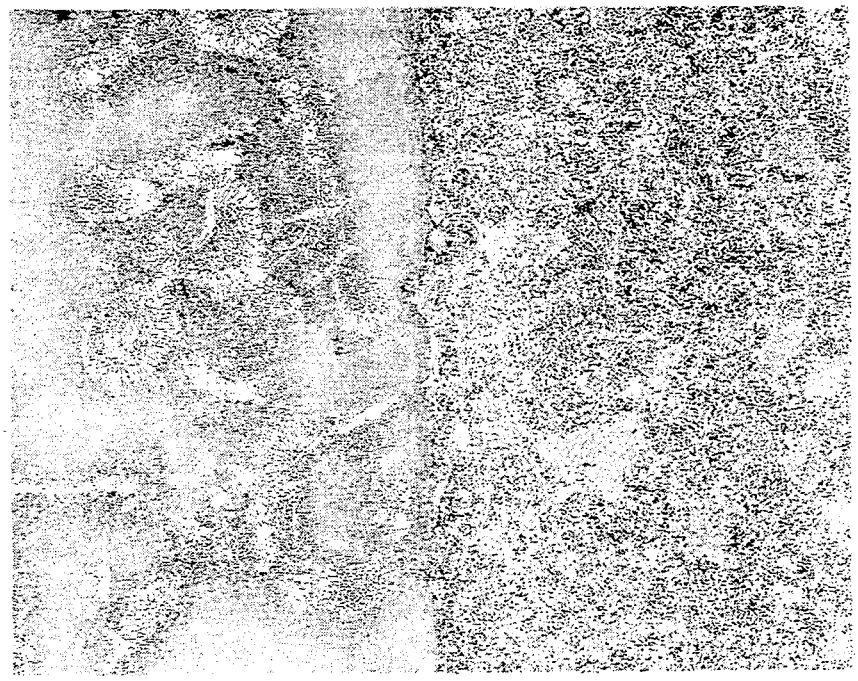
FIG. 3 is a photomicrograph (at 200x) of the bond between cast Mar M247 and sprayed LC Astrology.

The integrity of the metallurgical bond produced in this example was of excellent quality and relatively free of non-metallic contaminants, as shown in FIG. 3. The solidified metal hub demonstrates the uniform fine grain size and microstructure desirable for the hub section of a dual-property turbine rotor.

Mechanical test specimens were taken from the composite rotor shown in this example from three locations: (a) in the spray deposited portion 18, (b) in the cast member 10, and (c) across the metallurgical bond such that the bond joint was substantially in the center of the gauge section. Prior to sectioning the preform was heat treated according to 2040° F./2 h/AC+1600° F./8 h/AC+1800° F./4 h/AC+1200° F./24 h/AC+1400° F./8 h/AC. Results of tensile tests of those specimens at 75° F., 1000° F., and 1400° F. are given in Table II. The sprayed member exhibited excellent strength and ductility values owing to the fine grain size and low interstitial gas contents produced by this invention. The tensile bond joint properties were essentially equivalent to the cast blade ring properties.

EXAMPLE 2

A dual-alloy composite rotor with a graded grain size metal hub was produced by controlling specific plasma process parameters of the method described in Example 1. Varying the dynamic chamber pressure between 40 and 45 torr during spraying and adding transferred arc at decreasing power levels from about 10 kw to 2 kw produced a larger grain size of about 60-80 microns in diameter in the solidified hub near the cast ring interface. By gradually changing the plasma process parameters to the conditions in Example 1, the typical fine grain size of about 20-30 microns in diameter, such as shown previously in FIG. 3, was produced in the central region of the solidified metal hub.

Achieving a tailored grain size in a dual-alloy composite rotor in a single step process has not been accomplished prior to this invention. Those skilled in the art will recognize the benefits of a graded grain size for applications, such as gas turbine engines, where the composite article will be exposed to high gradients of stress and temperature.

EXAMPLE 3

A superalloy known as AF2-1DA-6, (its composition is set out in Table I) was produced by the method of Example 1 and its microstructural stability was compared to the alloy produced by conventional extruded powder metallurgy. Each material initially exhibited a uniform, fine grain size of 20-30 microns. Samples of both materials were given a 2200° F. exposure for 40 hours. Thermally induced porosity (TIP) was observed in the conventionally processed material. No porosity was detected in the sprayed alloy. The conventionally processed material also exhibited grain growth resulting in grain size of 80 to 100 microns. Only minor grain coarsening (40-50 microns) was observed in the sprayed material.

The unexpected phenomena of extended grain size stability offers the capability for higher temperature hot pressing and heat treatment of the composite article.

TABLE I

| Element (w/o) | Compositions of Nickel-Base Superalloys: Cast Alloy Mar-M247 | Powder Alloy LC Astroloy | Powder Alloy AF2-1DA-6 |
|---|---|---|---|
| Ni | Bal | Bal | Bal |
| Cr | 8.0 | 15.0 | 12.0 |
| Co | 10.0 | 17.0 | 9.69 |
| Mo | 0.6 | 5.0 | 2.96 |
| W | 10.0 | — | 6.6 |
| Ta | 3.0 | — | 1.47 |
| Al | 5.5 | 4.0 | 4.4 |
| Ti | 1.0 | 3.5 | 2.77 |
| Hf | 1.5 | — | — |
| C | 0.16 | 0.03 | 0.04 |
| B | 0.02 | 0.02 | 0.02 |
| Zr | 0.09 | 0.06 | 0.02 |
| $O_2$(ppm) | 12 | 110 | 118 |
| $N_2$(ppm) | 10 | 28 | 36 |

The present invention has been disclosed in terms of preferred embodiments but is not limited thereto. The scope of the invention is to be determined by the appended claims and their equivalents.

TABLE II

TYPICAL TENSILE PROPERTIES OF COMPOSITE ROTOR*

| Temp. (°F.) | Preform Location | UTS (KSI) | 0.2% YS (KSI) | EL (%) | RA (%) |
|---|---|---|---|---|---|
| 75 | LC Astroloy | 210.2 | 152.5 | 21.8 | 20.2 |
| | Cast Mar-M247 | 131.6 | 118.8 | 3.9 | 9.8 |
| | Metallurgically Bonded | 129.0 | 120.5 | 2.7 | 8.1 |
| 1000 | LC | 195.7 | 140.3 | 25.9 | 26.2 |

TABLE II-continued

TYPICAL TENSILE PROPERTIES OF COMPOSITE ROTOR*

| Temp. (°F.) | Preform Location | UTS (KSI) | 0.2% YS (KSI) | EL (%) | RA (%) |
|---|---|---|---|---|---|
| | Astroloy Cast | 139.8 | 122.5 | 3.2 | 13.3 |
| | Mar-M247 Metallurgically Bonded | 140.0 | 123.8 | 4.2 | 10.7 |
| 1400 | LC | 150.2 | 134.6 | 20.1 | 21.5 |
| | Astroloy Cast | 132.0 | 114.5 | 4.9 | 12.1 |
| | Mar-M247 Metallurgically Bonded | 143.3 | 124.2 | 3.6 | 4.9 |

*HIP: 2165° F./25 ksi/4h
Heat Treatment: 2040° F./2h/AC + 1600° F./8h/AC + 1800° F./4h/AC + 1200° F./24h/AC + 1400° F./8h/AC

What is claimed is:

1. A method of making a composite metal article by spraying molten metal on the surface of at least one solid metal member, said method comprising the steps of:

providing a solid metal member;

facilitating the formation of a metallurgical bond at the interface between the surface of said metal member and metal sprayed thereon by cleaning the surface of said metal member and preheating said metal member in a controlled atmosphere at low pressure;

spraying molten metal onto the surface of said metal member;

rapidly solidifying said molten metal incrementally to form a solid partially porous sprayed metal portion adherent to at least a portion of the surface of said metal member to form a composite preform;

reducing residual stresses at said interface by cooling said preform at a sufficiently low cooling rate; and hot pressing said preform to substantially eliminate voids in said sprayed metal portion and metallurgically bond said sprayed metal portion to the surface of said metal member.

2. The method of claim 1 wherein said solid metal member is substantially gas impervious, said method including the steps of forming a gas impervious layer on the surface of said partially porous sprayed metal portion and hot isostatic pressing said preform.

3. The method of claim 1 wherein said metal article comprises nickel.

4. The method of claim 3 wherein said metal member is preheated in the range of from about 1500° F. to 1800° F.

5. The method of claim 1 wherein the step of preheating said metal member comprises the step of impinging a high velocity thermal plasma on said metal member.

6. The method of claim 5 wherein the step of cleaning the surface of said metal member is accomplished by forming a direct current arc on the surface of said metal member, the surface of said metal member being the cathode.

7. The method of claim 1 wherein the step of spraying molten metal is accomplished by injecting powdered metal into a plasma directed at said solid metal member.

8. The method of claim 7 wherein said metal comprises nickel.

9. The method of claim 1 including the step of moving said solid metal member with respect to means for spraying said molten metal while spraying said molten metal onto the surface of said metal member.

10. The method of claim 1 wherein said solid metal article comprises a directionally solidified metal member.

11. The method of claim 1 wherein said solid metal article comprises a single crystal metal member.

12. The method of claim 1 including the step of changing parameters associated with the step of spraying said molten metal to change the grain size of said sprayed metal portion.

13. A method of making a composite metal article of near theoretical density comprised of at least one single crystal member metallurgically bonded to a fine grained portion, said method comprising the steps of:

providing at least one gas impervious solid metal member, said solid metal member being a single crystal;

facilitating the formation of a metallurgical bond between said fine grained portion and said single crystal member by cleaning the surface of said single crystal member where it is disposed to contact said fine grained portion, said cleaning step being in a controlled atmosphere at low pressure;

preheating said single crystal member in a controlled atmosphere at low pressure;

spraying molten metal within a high velocity thermal plasma onto the surface of said single crystal member;

rapidly solidifying said molten metal incrementally to form a fine-grained solid partially porous sprayed metal portion adherent to at least a portion of said single crystal solid metal member to form a composite preform;

forming a gas impervious layer on the surface of said partially porous sprayed metal portion;

reducing residual stresses in said preform by cooling said composite preform at a sufficiently low cooling rate; and hot isostatically pressing said composite preform to substantially eliminate voids in said sprayed metal portion and metallurgically bond said sprayed metal portion to said single crystal member.

14. A method of making a composite metal article by spraying molten metal into at least one solid metal member, said method comprising the steps of:

providing a solid, gas impervious metal member, said member containing a cavity therein;

facilitating the formation of a metallurgical bond at the interface between the surface of said cavity and metal sprayed thereon by cleaning the surface of said cavity and preheating said metal member in a controlled atmosphere at low pressure;

spraying molten metal into said cavity;

rapidly solidifying said molten metal incrementally within said cavity to form a solid partially porous sprayed metal portion, said metal portion substantially filling said cavity and being adherent to at least a portion of the surface of said cavity to form a composite preform, with the outermost portion of the solidified metal portion being substantially gas impervious;

reducing residual stresses at said interface by cooling said preform at a sufficiently low cooling rate; and hot isostatically pressing said preform to substantially eliminate voids in said sprayed metal portion and metallurgical bond said sprayed metal portion to the surface of said cavity.

15. The method of claim 14 wherein said metal article comprises nickel.

16. The method of claim 15 wherein said metal member is preheated in the range of from about 1500° F. to 1800° F.

17. The method of claim 14 wherein the step of preheating said metal member comprises the step of impinging a high velocity thermal plasma on said metal member.

18. The method of claim 17 wherein the step of cleaning the surface of said metal member is accomplished by forming a direct current arc on the surface of said metal member, the surface of said metal member being the cathode.

19. The method of claim 14 wherein the step of spraying molten metal is accomplished by injecting powdered metal into a high velocity thermal plasma directed at said solid metal member.

20. The method of claim 19 wherein said metal comprises nickel.

21. The method of claim 20 including the step of moving said solid metal member with respect to means for spraying said molten metal while spraying said molten metal onto the surface of said metal member.

22. The method of claim 20 including the step of forming said sprayed metal portion with a different grain size in different parts of said sprayed metal portion.

23. A method of making a composite metal article by spraying molten metal into at least one solid metal member, said method comprising the steps of:

providing a solid, gas impervious metal member, said member containing a cavity therein;

facilitating the formation of a metallurgical bond at the interface between the surface of said cavity and metal sprayed thereon by cleaning the surface of said cavity and pre-heating said metal member in a controlled atmosphere at low pressure;

injecting metal powder into a high-velocity thermal plasma directed at said cavity to form a spray of molten metal;

spraying molten metal into said cavity;

rapidly solidifying said molten metal incrementally within said cavity to form a solid partially porous sprayed metal portion, said metal portion substantially filling said cavity and being adherent to at least a portion of the surface of said cavity to form a composite preform, with the outermost portion of the solidified metal portion being substantially gas impervious;

reducing residual stresses at said interface by cooling said preform at a sufficiently low cooling rate; and hot isostatically pressing said preform to substantially eliminate voids in said sprayed metal portion and metallurgical bond said sprayed metal portion to the surface of said cavity.

24. The method of claim 23 wherein said metal article comprises nickel.

25. The method of claim 24 wherein said metal member is preheated in the range of from about 1500° F. to 1800° F.

26. The method of claim 24 wherein the step of preheating said metal member comprises the step of impinging a high-velocity thermal plasma on said metal member.

27. The method of claim 26 wherein the step of cleaning the surface of said metal member is accomplished by forming a direct current arc on the surface of said metal member, the surface of said metal member being the cathode.

28. The method of claim 23 wherein the step of spraying molten metal is accomplished by injecting powdered metal into a high velocity thermal plasma directed at said solid metal member.

29. The method of claim 23 including the step of rotating said solid metal member while spraying said molten metal onto the surface of said metal member.

* * * * *